US009646476B1

(12) United States Patent
Hansen

(10) Patent No.: US 9,646,476 B1
(45) Date of Patent: May 9, 2017

(54) GAS-MONITORING AND FALL DETECTION DEVICE

(71) Applicant: Marcus Hansen, Vernal, UT (US)

(72) Inventor: Marcus Hansen, Vernal, UT (US)

( * ) Notice: Subject to any disclaimer, the term of this patent is extended or adjusted under 35 U.S.C. 154(b) by 135 days.

(21) Appl. No.: 14/666,439

(22) Filed: Mar. 24, 2015

(51) Int. Cl.

| | |
|---|---|
| ***G08B 23/00*** | (2006.01) |
| ***G08B 21/14*** | (2006.01) |
| ***G08B 3/10*** | (2006.01) |
| ***G08B 5/36*** | (2006.01) |

(52) U.S. Cl.
CPC ..... *G08B 21/14* (2013.01); *G08B 3/10* (2013.01); *G08B 5/36* (2013.01)

(58) Field of Classification Search
None
See application file for complete search history.

(56) References Cited

U.S. PATENT DOCUMENTS

| | | | | |
|---|---|---|---|---|
| 6,703,939 | B2 | 3/2004 | Lehrman | |
| 7,423,537 | B2 | 9/2008 | Bonnet | |
| 8,063,771 | B2 | 11/2011 | Nix | |
| 8,217,795 | B2 | 7/2012 | Carlton-Foss | |
| 8,325,053 | B2 | 12/2012 | Flynt | |
| 8,531,291 | B2 * | 9/2013 | Tran | G06F 19/3418 340/3.1 |
| 2012/0286949 | A1 * | 11/2012 | Worthington | F16P 3/14 340/539.1 |
| 2013/0122849 | A1 * | 5/2013 | Doezema | A61B 5/002 455/404.1 |
| 2014/0247153 | A1 * | 9/2014 | Proud | A61B 5/002 340/870.09 |
| 2014/0254060 | A1 * | 9/2014 | Malone | A01K 79/02 361/232 |
| 2015/0375242 | A1 * | 12/2015 | Haviland | B05B 1/30 239/11 |
| 2016/0140834 | A1 * | 5/2016 | Tran | G06F 19/3418 340/539.11 |

* cited by examiner

*Primary Examiner* — Julie Lieu

(57) ABSTRACT

The gas monitoring and fall detection device is a safety device intended to be worn by special duty personnel, such as maintenance people, who do not work in a set location and may inadvertently stray into dangerous situations. The gas monitoring and fall detection device monitors the working environment for dangerous gas levels and, when a dangerous gas level is detected, generates an alarm to the wearer and transmits an alarm to a supervisory station. The gas monitoring and fall detection device also contains an accelerometer to detect falls and a GPS module to provide the location of the wearer. The gas monitoring and fall detection device comprises a monitoring unit that is worn by the wearer and a supervisory station to receive the transmitted alarm information.

8 Claims, 5 Drawing Sheets

GAS-MONITORING AND FALL DETECTION DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of safety devices and signal monitoring equipment, more specifically, an accessory that monitors levels of harmful gasses and falls.

SUMMARY OF INVENTION

The gas monitoring and fall detection device is a safety device intended to be worn by special duty personnel, such as maintenance people, who do not work in a set location and may inadvertently stray into dangerous situations. The gas monitoring and fall detection device monitors the working environment for dangerous gas levels and, when a dangerous gas level is detected, generates an alarm to the wearer and transmits an alarm to a supervisory station. The gas monitoring and fall detection device also contains an accelerometer to detect falls and a GPS module to provide the location of the wearer. The gas monitoring and fall detection device comprises a monitoring unit that is worn by the wearer and a supervisory station to receive the transmitted alarm information.

These together with additional objects, features and advantages of the gas monitoring and fall detection device will be readily apparent to those of ordinary skill in the art upon reading the following detailed description of the presently preferred, but nonetheless illustrative, embodiments when taken in conjunction with the accompanying drawings.

In this respect, before explaining the current embodiments of the gas monitoring and fall detection device in detail, it is to be understood that the gas monitoring and fall detection device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gas monitoring and fall detection device.

It is therefore important that the claims be regarded as including such equivalent construction insofar as they do not depart from the spirit and scope of the gas monitoring and fall detection device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
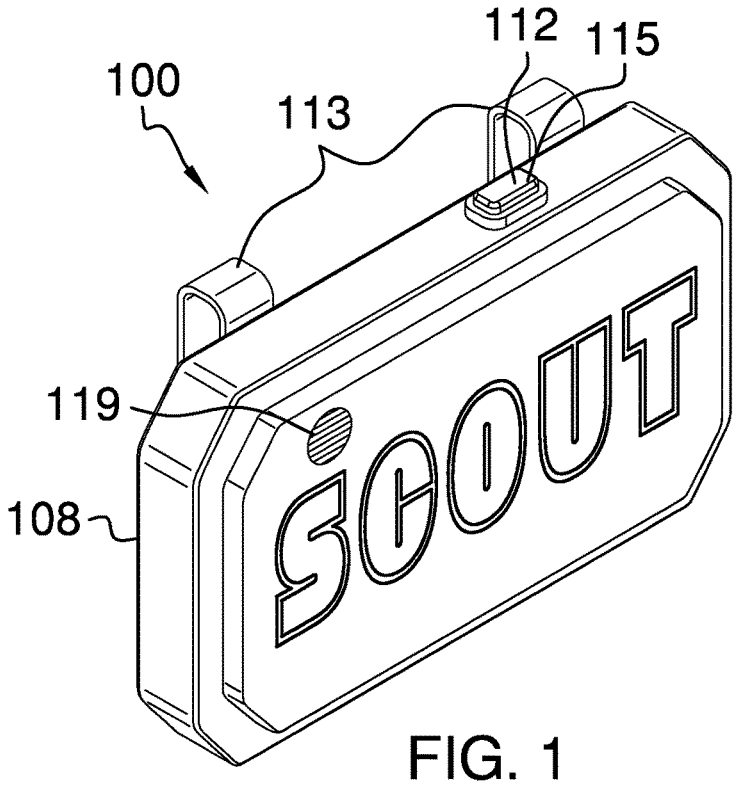
FIG. 1 is a perspective view of an embodiment of the disclosure.
Figure 2:
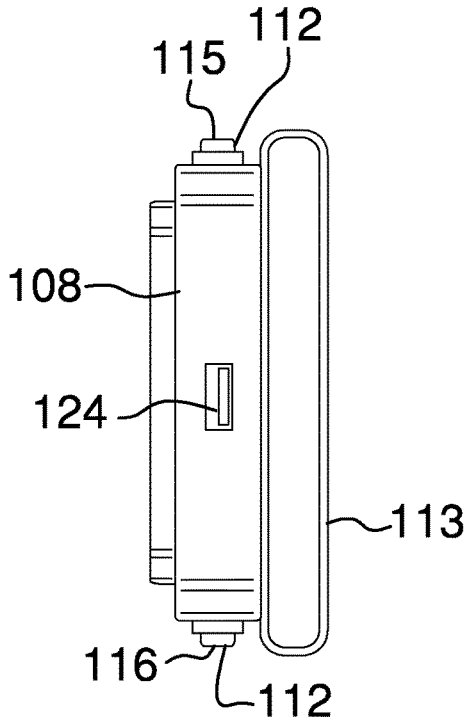
FIG. 2 is a side view of an embodiment of the disclosure.
Figure 3:
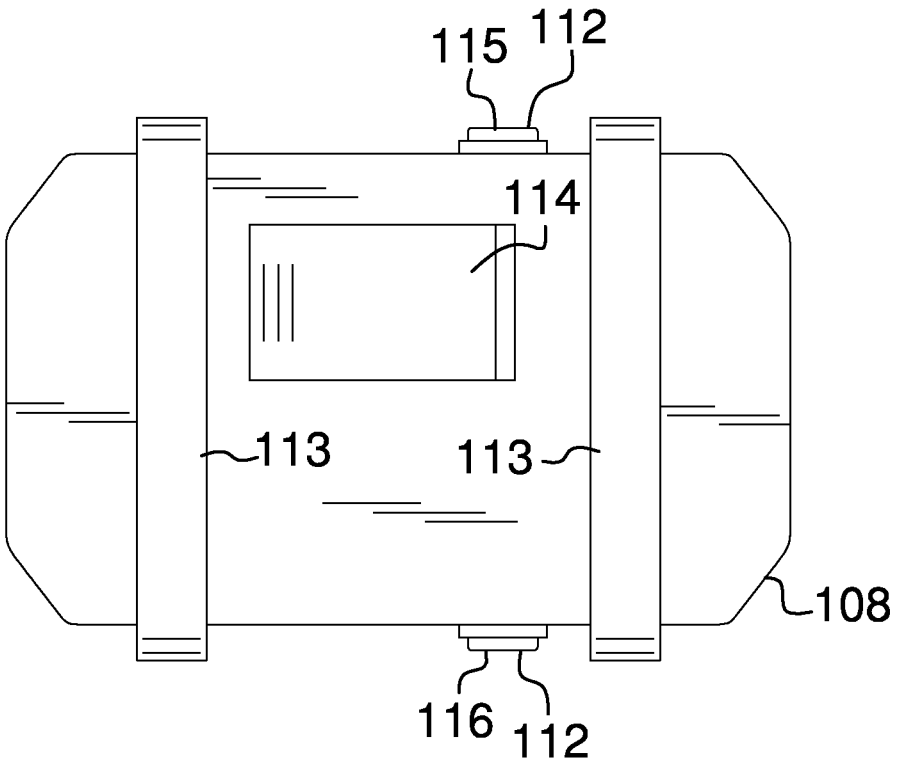
FIG. 3 is a back view of an embodiment of the disclosure.
Figure 4:
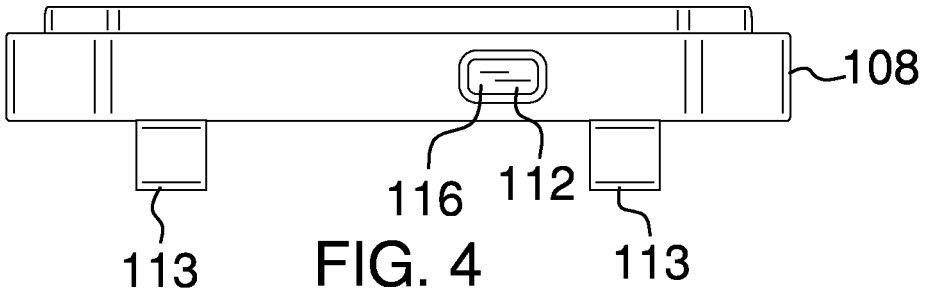
FIG. 4 is a bottom view of an embodiment of the disclosure.
Figure 5:
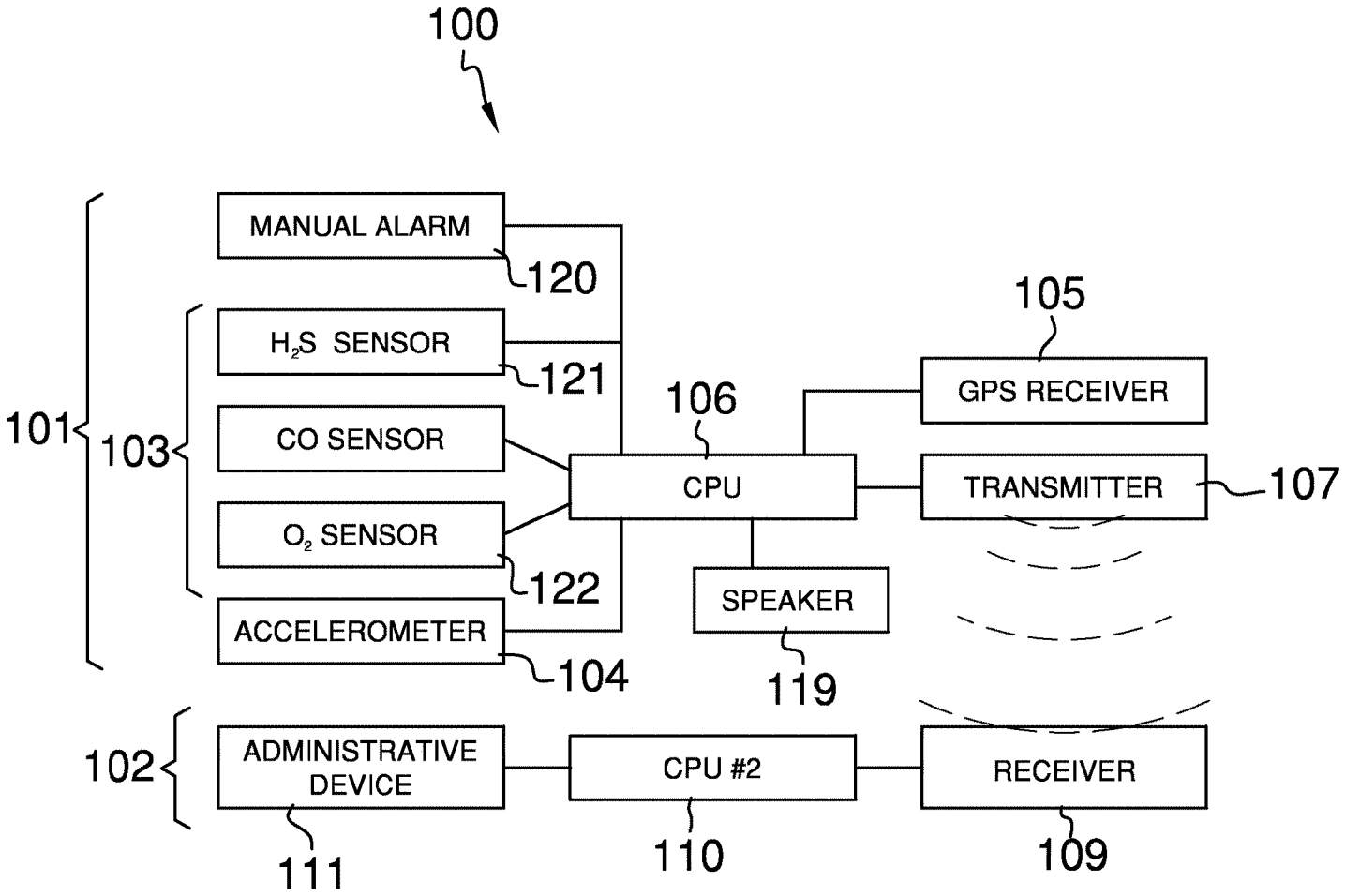
FIG. 5 is a block diagram view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7. The gas monitoring and fall detection device 100 (hereinafter invention) comprises a monitoring unit 101 and a supervisory unit 102.

The monitoring unit 101 comprises a plurality of sensors 103, an accelerometer 104, a GPS receiver 105, a first CPU 106, a first transmitter 107, a housing 108, and a speaker 119. The first CPU 106 comprises the electronic circuitry required to implement the logical, control and input output functions required to carry out the instructions of a computer program. The functions of the first CPU 106 comprise monitoring the plurality of sensors 103, monitoring the accelerometer 104, monitoring the GPS receiver 105, and managing and monitoring the first transmitter 107.

The plurality of sensors 103 collectively monitor the immediate environment for hazards that may be dangerous for the wearer of the invention 100. Appropriate sensors for use as one of the plurality of sensors 103 includes, but is not limited to, sensors for: methane, hydrogen, liquefied petroleum gas, carbon dioxide, carbon monoxide, oxygen, hydrogen sulfide, ammonia, alpha radiation, beta radiation, gamma radiation and X-rays. The accelerometer 104 is a triple axis accelerometer capable of measuring dynamic acceleration from motion or shock. The GPS receiver 105 receives signals from the global positioning system and coverts this information into the longitude and latitude of the GPS receiver 105. This information is provided to the first CPU 106. The function of the first transmitter 107 is to receive the alarm generated by the first CPU 106, encode the alarm into a transmittable form and to transmit the alarm to the supervisory unit 102. The speaker 119 allows for local alarm signals to be provided.

The housing 108 comprises a USB port 124, one or more manual alarm buttons 112, a belt strap 113, and a battery compartment 114. The purpose of the housing 108 is to contain the plurality of sensors 103, the accelerometer 104, the GPS receiver 105, the first CPU 106, the first transmitter 107, and the speaker 119 as well as to provide for user interfaces and an electrical power source for the operation of the monitoring unit 101.

The purpose of the USB port 124 is to provide external power to the monitoring unit 101 as well as to provide a communication port that allows direct communication between the monitoring unit 101 and the supervisory unit 102. The one or more alarm buttons 112 allow the wearer to manually generate an alarm by pushing one of the one or more alarm buttons 112. Once an alarm has been generated, the wearer can discontinue transmittal of the alarm by pushing one of the one or more alarm buttons 112 three times. The purpose of the belt strap 113 is to provide a convenient way to attach the monitoring unit 101 to the wearer's body. The battery compartment 114 stores the batteries required to operate the invention 100.

The first CPU 106 regularly monitors the plurality of sensors 103 and compares the plurality of sensor readings 103 against predetermined normal ranges for each of the plurality of sensors 103. Should the reading from one of the plurality of sensors 103 be outside the predetermined normal range for that sensor, the first CPU 106 sends an alarm signal to the speaker 119 and an alarm message to the first transmitter 107.

The first CPU 106 regularly monitors the accelerometer 104 and compares the accelerometer 104 against a predetermined normal range for the accelerometer 104. Should the reading from accelerometer 104 be outside the predetermined normal range for the accelerometer 104, the first CPU 106 sends an alarm signal to the speaker 119 and an alarm message to the first transmitter 107.

The first CPU 106 regularly queries the GPS receiver 105 for updates regarding the current location of the monitoring unit 101. Should contact with the global positioning system be lost, the first CPU 106 sends an alarm signal to the speaker 119 and an alarm message to the first transmitter 107.

The alarm sent to the speaker 119 comprises a thirty second AC voltage that is generated at an audible frequency that will be converted by the speaker 119 into an audible sound. The contents of the alarm sent to the first transmitter 107 includes the most recent global positioning system location as well as an identification of how the alarm was generated. Once generated, an alarm transmits continuously until discontinued by pressing one of the one or more manual alarm buttons 112 three times.

Commercially available microcontroller systems can be used as the first CPU 106 including, but not limited to, Arduino based systems and Raspberry Pi based systems. Commercially available sensors, including accelerometers, and GPS receivers can be used. Commercially available transmitters including, but not limited to, radio frequency transmitters, Bluetooth (IEEE 802.15.1), or WiFi (IEEE 802.11) based systems can be used. In addition, commercially available electronics that send text messages directly through the cellular system can be used as the first transmitter 107. Speakers, alarm buttons, battery compartments and batteries are readily available. Methods for programming microcontrollers and interfacing microcontrollers to sensors and transmitters are well known and documented in the art.

The supervisory unit 102 comprises a first receiver 109, a second CPU 110, an administrative device 111. The second CPU 110 comprises the electronic circuitry required to implement the logical, control and input output functions required to carry out the instructions of a computer program. The first receiver receives and decodes the alarm transmitted by the monitoring unit 101 and forwards the alarm to the second CPU 110. The CPU then generates the appropriate alarms at the location of the supervisory unit 102 and passes the alarm information to the administrative device 111. The administrative device 111 logs the alarm as well as any safety or location information that was transmitted. In a second potential embodiment of the disclosure, the administrative device 111 and the second CPU 110, and monitoring unit 101 can be also adapted to collect and store time stamps and location tracking information that the monitoring unit 101 collects through the shift. Optionally, a USB connection between the monitoring unit 101 and the supervisory unit 102 to download the time stamps and location tracking information.

Commercially available microcontroller systems can be used as the second CPU 110 including, but not limited to, Arduino based systems and Raspberry Pi based systems. Commercially available devices and software are available to perform the functions of the administrative device 111. The functions of the administrative device 111 can also be incorporated into the second CPU 110. Commercially available receivers including, but not limited to, radio frequency transmitters, Bluetooth (IEEE 802.15.1), or WiFi (IEEE 802.11) based systems can be used so long as it matches the first transmitter 107 used.

In the first potential embodiment of the disclosure the plurality of sensors 103 selected were a hydrogen sulfide detector 120, a carbon monoxide sensor 121, and an oxygen sensor 122. The housing 108 incorporates a first manual alarm button 115 and a second manual alarm button 116. The first CPU 106 is an Arduino based microcontroller that is powered by a 9 volt battery. The battery may be rechargeable. The second CPU 110 is an Arduino based microcontrollers. Commercially available Arduino housings were used in the first potential embodiment of the disclosure. The first CPU 106 may include a memory unit 166 that is used to store biographical information about a user. The biographical information about the user may include medical contacts, family emergency contact information, allergies, prescribed medicine, age, sex, medical conditions, etc.

Figure 7:
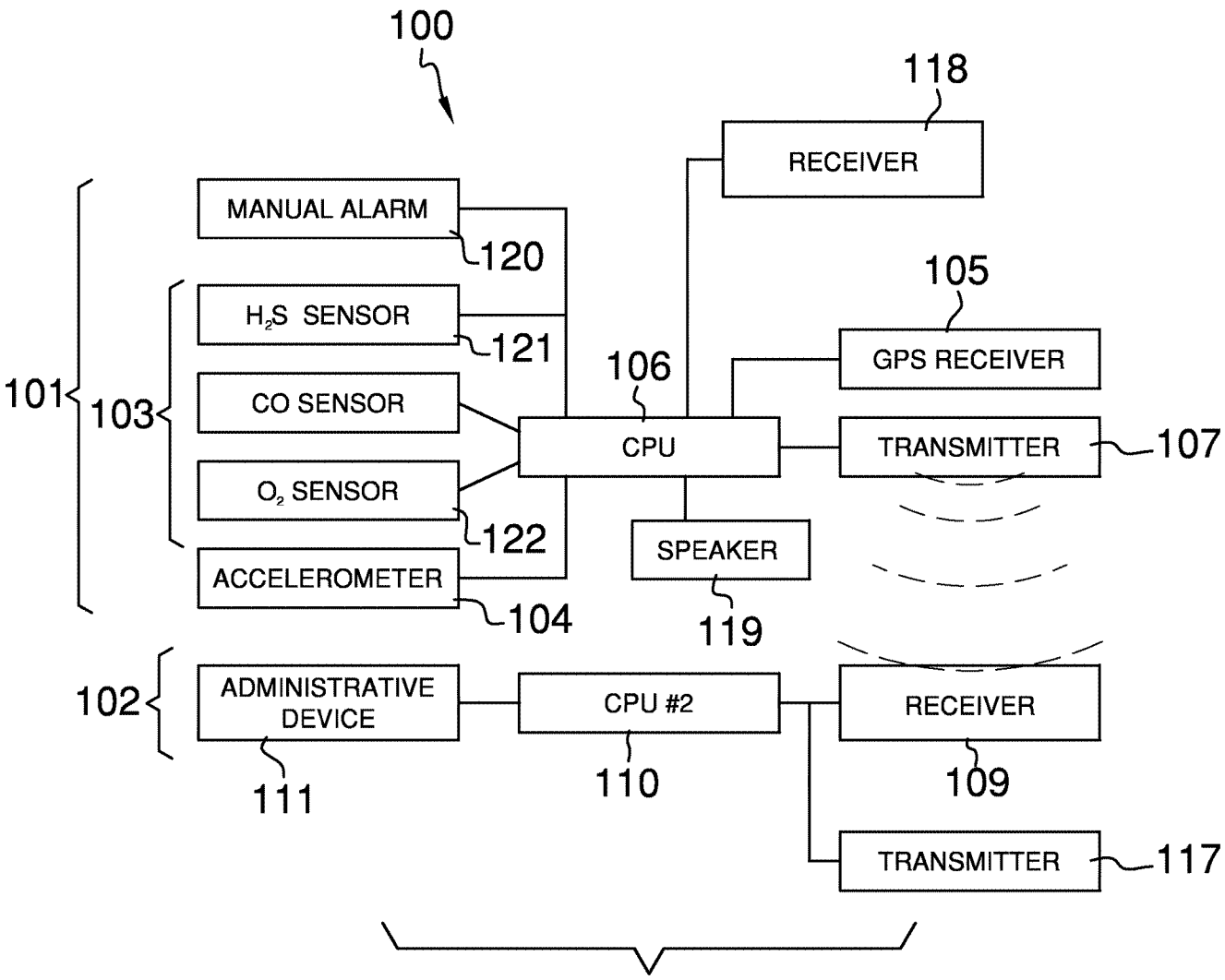
FIG. 7 is a block diagram view of an alternate embodiment of the disclosure.

In a third potential embodiment of the disclosure, most clearly illustrated in FIG. 7, a second transmitter 117 is added to the supervisory unit 102 and a second receiver 118 is added to monitoring unit 101. In the third potential embodiment of the disclosure, an operator at the supervisory unit 102 has the ability to transmit a query to the monitoring unit 101 requesting that sensor and location information be sent by the monitoring unit 101 to the supervisory unit 102.

Figure 6:
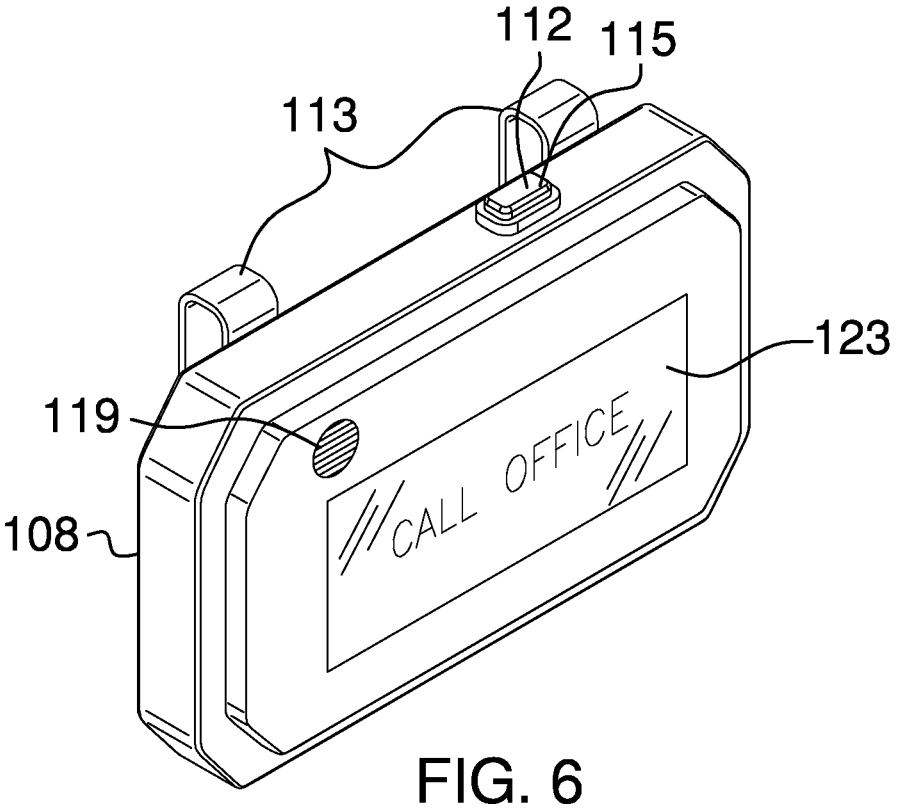
FIG. 6 is a perspective view of an alternate embodiment of the disclosure.

A fourth potential embodiment of the disclosure, most clearly illustrated in FIG. 6, is an extension of the third potential embodiment of the disclosure. In the fourth potential embodiment of the disclosure, a liquid crystal display 123 is added to the housing 108 of the second potential embodiment of the disclosure. This allows an operator at the supervisory unit 102 to send a brief message to the monitoring unit 101 that can be read by the wearer.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A gas monitoring and fall detection device comprising a monitoring unit and a supervisory unit;

wherein the gas monitoring and fall detection device monitors the local environment for hazards;

wherein when a hazard is detected an alarm is generated at the monitoring unit;

wherein when a hazard is detected an alarm is generated at the supervisory unit;

wherein the alarm generated at the supervisory unit includes information about the location of the monitoring unit when the alarm was generated;

wherein the monitoring unit comprises a plurality of sensors, an accelerometer, a GPS receiver, a first CPU, a first transmitter, a housing, and a speaker;

wherein the supervisory unit comprises a first receiver, a second CPU, an administrative device;

wherein the first CPU monitors the plurality of sensors;

wherein the first CPU monitors the accelerometer;

wherein the first CPU monitors the GPS receiver;

wherein the GPS receiver receives signals from the global positioning system and coverts this information into the longitude and latitude of the location of the GPS receiver;

wherein the first transmitter receives a predetermined alarm message generated by the first CPU, encodes the alarm into a transmittable form and transmits the alarm to the supervisory unit;

wherein the housing is a container that comprises a USB port, one or more manual alarm buttons, a belt strap, and a battery compartment;

wherein the housing contains the plurality of sensors, the accelerometer, the GPS receiver, the first CPU, the first transmitter, and the speaker;

wherein the one or more alarm buttons allow the wearer to manually generate an alarm;

wherein the USB port provides external power to the monitoring unit;

wherein the USB port provides for direct communication between the monitoring unit and the supervisory unit;

wherein the first CPU compares each of the plurality of sensor readings against predetermined normal ranges for each of the plurality of sensors;

wherein when the reading from one of the plurality of sensors is outside the predetermined normal range for that sensor the first CPU sends an alarm signal to the speaker;

wherein when the reading from one of the plurality of sensors is outside the predetermined normal range for that sensor the first CPU sends the predetermined alarm message to the first transmitter;

wherein the first CPU regularly monitors the accelerometer and compares the accelerometer against a predetermined normal range for the accelerometer;

wherein when the reading from the accelerometer is outside the predetermined normal range for the accelerometer the first CPU sends an alarm signal to the speaker;

wherein when the reading from the accelerometer is outside the predetermined normal range for the accelerometer the first CPU sends the predetermined alarm message to the first transmitter;

wherein the first CPU regularly queries the GPS receiver for the current location of the monitoring unit;

wherein when contact with the global positioning system is lost, the first CPU sends an alarm signal to the speaker;

wherein when contact with the global positioning system is lost, the first CPU sends the predetermined alarm message to the first transmitter.

2. The gas monitoring and fall detection device according to claim 1 wherein each of the plurality of sensors monitor the immediate environment for hazards; wherein each of the plurality of sensors is selected from a group consisting of methane sensors, hydrogen sensors, liquefied petroleum gas sensors, carbon dioxide sensors, carbon monoxide sensors, oxygen sensors, hydrogen sulfide sensors, ammonia sensors, alpha radiation sensors, beta radiation sensors, gamma radiation sensors and X-ray sensors.

3. The gas monitoring and fall detection device according to claim 1 wherein the accelerometer is a triple axis accelerometer.

4. The gas monitoring and fall detection device according to claim 1 wherein the contents of the predetermined alarm message sent to the first transmitter includes the most recent global positioning system location and the sensor information that generated the reading outside the normal range.

5. The gas monitoring and fall detection device according to claim 4 wherein the first receiver receives and decodes the predetermined alarm message transmitted by the monitoring unit;

wherein the first receiver forwards the predetermined alarm message transmitted by the monitoring unit to the second CPU;

wherein the second CPU generates the appropriate alarms at the location of the supervisory unit;

wherein the second CPU and passes the predetermined alarm message to the administrative device;

wherein the administrative device logs the predetermined alarm message;

wherein a hydrogen sulfide detector is provided;

wherein a carbon monoxide sensor is provided;

wherein an oxygen sensor is provided;

wherein a first manual alarm button is provided;

wherein a second manual alarm button is provided.

6. The gas monitoring and fall detection device according to claim 4 wherein the administrative device, the second CPU, and monitoring unit are adapted to collect and store location tracking information collected by the monitoring unit.

7. The gas monitoring and fall detection device according to claim 4 wherein a second transmitter is added to the supervisory unit; wherein a second receiver is added to monitoring unit.

8. The gas monitoring and fall detection device according to claim 7 wherein a liquid crystal display is added to the housing.

* * * * *